United States Patent [19]

Takai et al.

[11] Patent Number: 4,786,782

[45] Date of Patent: Nov. 22, 1988

[54] ELECTRIC INSTANTANEOUS WATER HEATER WITH ENHANCED TEMPERATURE CONTROL

[75] Inventors: Mitsuo Takai, Nara; Takashi Tanahashi, Ikoma; Masahito Uemura, Kashiwara; Yasukiyo Ueda, Shiki, all of Japan

[73] Assignee: Matsushita Electric Industrial Co., Ltd., Osaka, Japan

[21] Appl. No.: 887,924

[22] Filed: Jul. 22, 1986

[30] Foreign Application Priority Data

| | | | |
|---|---|---|---|
| Jul. 22, 1985 | [JP] | Japan | 60-161402 |
| Sep. 20, 1985 | [JP] | Japan | 60-209129 |
| Sep. 20, 1985 | [JP] | Japan | 60-209151 |

[51] Int. Cl.[4] ..... H05B 1/02; H05B 3/82; F24H 1/10

[52] U.S. Cl. ..... 219/306; 219/308; 219/316; 219/322; 219/328

[58] Field of Search ..... 219/296–299, 219/303–309, 310, 312, 314, 316, 318

[56] References Cited

U.S. PATENT DOCUMENTS

| | | | |
|---|---|---|---|
| 942,894 | 12/1909 | Farren et al. | 219/298 |
| 1,519,395 | 12/1924 | Clemch | 219/299 |
| 1,634,704 | 7/1927 | Brand | 219/314 |
| 1,767,122 | 6/1930 | Dean | 219/314 X |
| 2,033,443 | 3/1936 | Moses | 219/314 |
| 2,446,367 | 8/1948 | Graves | 219/314 |
| 3,617,700 | 11/1971 | Hooper | 219/314 X |
| 4,358,665 | 11/1982 | Owen | 219/306 |

FOREIGN PATENT DOCUMENTS

| | | | |
|---|---|---|---|
| 2023590 | 11/1971 | Fed. Rep. of Germany | 219/306 |
| 2519536 | 7/1983 | France | 219/306 |
| 5549651 | 4/1980 | Japan | 219/306 |
| 8203115 | 9/1982 | PCT Int'l Appl. | 219/306 |
| 3221AD1914 | 4/1915 | United Kingdom . | |

OTHER PUBLICATIONS

Abstract of Japan 115931, Published Jul. 4, 1984, entitled "Heat Exchanger for Electric Tap-Controlled Hot Water Supplier, " (English Language Abstract of Oct. 31, 1984).

*Primary Examiner*—Anthony Bartis
*Attorney, Agent, or Firm*—Wenderoth, Lind & Ponack

[57] ABSTRACT

An instantaneous water heater with enhanced temperature control and less variation in output water temperature has an output hot water pipe extending into a heating tank through the top thereof and surrounded by a coiled sheath electric heater for heating the water in the tank, the output pipe extending to the tank bottom and provided with an inlet thereat. An inlet pipe for water to be heated extends into the bottom of the tank and is throttled to provide an accelerated flow of incoming water away from the heater and outlet pipe toward an overheat prevention thermostat mounted externally on the top of the tank and connected to the heater. An output hot water temperature sensor located within the output water pipe adjacent the inlet thereof cooperates with a control unit of regulating operation of the heater to maintain the hot water output temperature at a preset level. The inlet to the water output pipe is throttled to insure mixing of the heated water, accurate temperature measurement and the reduction of scale deposition on the temperature sensor.

15 Claims, 7 Drawing Sheets

ELECTRIC INSTANTANEOUS WATER HEATER WITH ENHANCED TEMPERATURE CONTROL

BACKGROUND OF THE INVENTION

1. Field of the Invention

The present invention relates to an electric instantaneous boiler which is used in the water heating operation for a shower or the like.

2. Description of the Prior Art

Conventionally, this type of electric instantaneous boiler, constructed as illustrated in FIG. 7, is disclosed in, for example, U.S. Pat. No. 4,358,665. Namely, valve 1 is opened and the pressure switch 2 is actuated by the water flow to turn the sheath heater 3 on. The water goes from the valve 1 to the lower portion of the tank 5 through the water pipe 4. The water goes to the upper portion of the tank 5 while being heated by the sheath heater 3 and flows into the inlet opening 6*a* of the hot water pipe 6 provided at the upper portion.

However, as seen in FIG. 9, the valve 1 is fully closed after a flow of 3 liters per minute at an input water temperature of 25° C., and an output hot water temperature of 40° C. owing to the setting of the valve 1. When the valve 1 is opened again after one minute, the overshoot, called after-boiling (owning to the residual heat of the heater), is caused as shown in FIG. 9, so that hot water of 50° C. is temporarily disadvantageously outputted immediately after the valve 1 has been opened. The reasons are as follows.

When the valve 1 closes, the water flow within the tank 5 also stops. Then, although the pressure switch 2 cuts off the sheath heater 3, the water within the tank 5 continues to be heated by the residual heat of sheath heater 3. As there is no flow, the water is still and a water temperature distribution, as shown in the solid line of FIG. 10, with respect to the depth of the tank, results. Namely, the highest portion of the tank becomes about 50° C. in temperature. A transition temperature gradient results between the upper portion and the lower portion of the tank so that the temperature decreases to about 25° C., an inputwater temperature, near the input water opening 4*a*. As the hot water is outputted through the hot water output pipe 6 from the high-temperature water of the tank upper portion when the valve 1 is opened, the overheating of the output hot water temperature becomes large. It is natural that this tendency becomes greater as the water volume of the boiler becomes smaller.

In the abnormal condition (hereinafter referred to simply as "abnormal condition") where the sheath heater 3 remains on although valve 1 is enclosed, the water temperature within the tank 5 and the temperature of the sheath heater 3 rise. The thermostat 7 for preventing the excessive temperature rise operates to stop the energization of the sheath heater 3.

However, in such construction as described hereinabove, it took a long time before the thermostat 7 for preventing the excessive rise of temperature responded to the abnormal condition. The resulting boiling water was jetted from the output hot water pipe 6, or, if boiling water was not discharged, the tank 5 was deformed by the resultant pressure buildup, thus resulting in a dangerous condition. The reasons are as follows.

Namely, the water temperature within the tank 5 near the temperature sensing portion 7*a* of the thermostat 7 during normal use is the highest of the water temperatures within the tank after the heating operation by the sheath heater 3. The temperature sensing portion 7*a* is normally kept highest in temperature by transfer heat from the U-shaped heater portion 3*a*. On the other hand, in the abnormal condition, the heat of the U-shaped heater portion 3*a* is robbed by the surrounding water, so that the temperature of sensing portion 7*a* is slow to rise in the abnormal condition. Also, the cut-off temperature of the temperature excessive-rise preventing operation is set with some tolerance (10° C. or more), with respect to the highest temperature during normal use, for error prevention. The thermal transfer dispersion is caused because of the contact condition between the brazing or the like between the U-shaped heater portion 3*a* and the inner face of the tank 5, so that the tolerance is required. As shown in FIG. 11, the temperature of the heat sensing portion 7*a* of the thermostat 7 during normal use become higher as the output hot water volume becomes smaller, so that the operation-off temperature of the thermostat 7 has to be set at the high value. Thus, more time passes before the thermostat 7 takes the operationoff action in the abnormal condition, thus resulting in a dangerous condition such as boiling water within the tank 5, jetting from the output hot water pipe 6, or a deformed tank owing to pressure buildup.

Also, another embodiment of this type of conventional electric instantaneous boiler is shown in Japanese Patent Publication (Tokkosho) No. 59-53450, as in the construction of FIG. 8.

Namely, the temperature sensing portion 8*a* of a temperature detector 8, composed of a thermistor or the like for detecting the output hot water temperature, is provided in proximity to a mixing portion 10 for stirring the heated water of the upper portion of the tank 9 and the sheath heater 11. The water inputted into the lower portion of the tank 9 from the input water pipe 12 goes towards the upper portion of the tank 9 while being heated by the sheath heater 11, and is outputted from the output hot water pipe 13 after it has been stirred in the mixing portion 10. The temperature detector 8 detects the temperature of the water flowing to the mixing portion 10. The semiconductor power control apparatus 14 which inputted the detection signal compares the detected temperature value with the set temperature value to control in pulse the switching element 14*a*, such as a triac or the like, in accordance with the deviation valve so as to control the supply power to the sheath heater 11 so that the deviation value may be kept at zero. However, in such construction as described herein-above, the output hot water temperature becomes unstable with ripples being larger, as shown in B in FIG. 6, when the valve 15 is throttled to reduce the flow amount. The reasons are as follows.

Namely, when the flow amount is reduced, the flow speed near the temperature sensing portion 8*a*, which speed is high in the flow-passage area on the sectional face of the tank 9, becomes very slow. As the sheath heater 11 and the temperature sensing portion 8*a* are placed nearer each other for better thermal response resulting from a reduction of lag time, which is caused by the distance L of the temperature sensing portion 8*a* from the sheath heater 11, the temperature sensing portion 8*a* is influenced by the surface temperature of the sheath heater 11 to render the output hot water temperature stable.

SUMMARY OF THE INVENTION

An instantaneous boiler has enhanced temperature control and less variation in the output hot water temperature owing to the location and operative connection of its key components within the water tank. An output hot water pipe is contained within the tank, surrounded by a sheath heater, and has its inlet at the bottom of the tank. The inlet pipe for water to be heated flows water into the tank at the bottom and directs the water away from the outlet hot water pipe and toward a thermostat at the top of the tank. The thermostat at the top of the tank has a first temperature sensing portion that measures (through the top wall of the tank) the temperature of the water to be heated, and the thermostat controls the heater. A second temperature sensor is contained within the output hot water pipe directly adjacent the inlet thereof. The second temperature sensor or sensing portion is connected to the semiconductor power control apparatus. The respective inlets of the input and output hot water pipes are throttled in order to accelerate the water. For the inlet water pipe this ensures that the water to be heated is accelerated past the heater and directed at the thermostat. For the output hot water pipe, the throttling ensures mixing of the heated water, accurate temperature measurement, and the accelerated water deposits less scale on the temperature sensor, thereby extending its life. The disposition of the thermostat also ensures that the unwanted condition of no water flow and continued heating of the heater is quickly detected as the thermostat is at the top outside surface of the tank nearest the hottest water, thereby enhancing the safety of the boiler.

BRIEF DESCRIPTION OF THE DRAWINGS

These and other objects and features of the present invention will become apparent from the following description taken in conjunction with the preferred embodiment thereof with reference to the accompanying drawings, in which.

DESCRIPTION OF THE PREFERRED EMBODIMENTS

Figure 1:
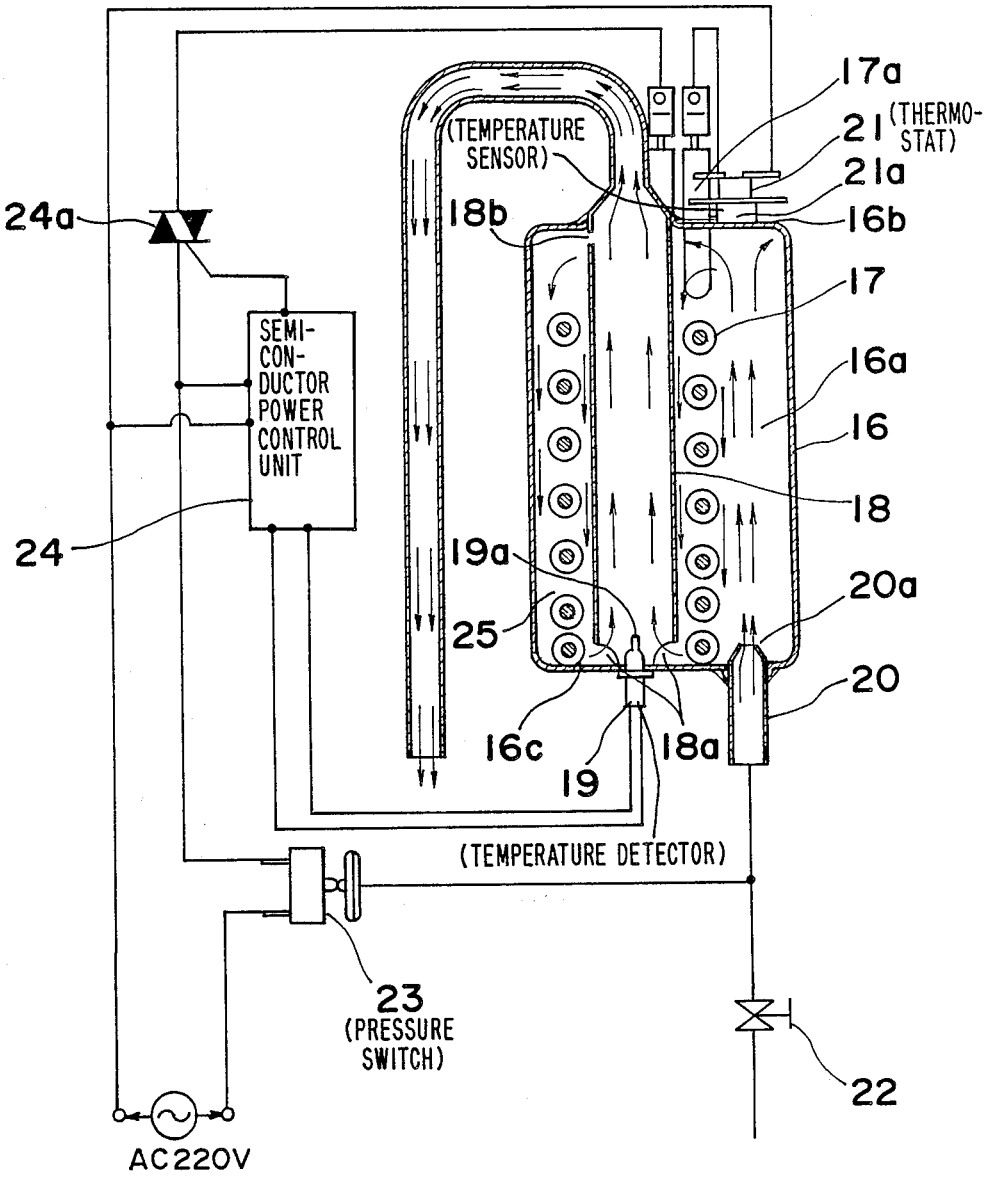
FIG. 1 is a longitudinal sectional view of the thermal exchange unit in one embodiment of the present invention.

Before the description of the present invention process, it is to be noted that like parts are designated by like reference numerals throughout the accompanying drawings.

Referring now to the drawings, there is shown in FIG. 1 a cylindrical copper-made tank 16 according to one preferred embodiment of the present invention. The coil-shaped sheath heater 17, which has its central axis in a position offset from central axis of the tank 16, is provided within the tank 16. The lead portion 17*a* at both ends of the sheath heater 17 is water-tightly soldered through the tank top-face 16*b* on the side of the space portion 16a of the tank 16. The output hot water pipe 18, whose outer diameter is close to the coil-shaped sheath heater inner diameter, is water-tightly soldered on the top face 16*b* of the tank 16 so that the first opening portion as the exit opening 18*a* from the tank 16 may come into proximity towards the tank bottom face 16*c*. The second opening portion 18*b*, serving as the air vent, is smaller than the first opening portion 18*a* and is provided in the topmost portion of output hot water pipe 18, which topmost portion is within the boundaries of tank 16. Also, a temperature detector 19 composed of a thermistor or the like for detecting the output hot water temperature is mounted on the tank bottom face 16*c* on the central axis of the output hot water pipe 18. The heat or temperature sensing portion 19*a* of the temperature detector or sensored 19 is position coincident with the central axis of the output hot water pipe 18 in the lower portion of the tank 16.

The input water pipe 20 with input water opening 20*a* of reduced cross-sectional area is water-tightly soldered on the bottom face 16*c* of the tank of the space portion 16a where no part of sheath heater 17 is provided. The temperature sensing portion 21*a* is provided on the tank top face 16*b* coincident with the central axis of the input water pipe 20, along with the thermostat 21 for preventing the excessive temperature rise.

The operation of the embodiment will be described hereinafter. A case will be described where valve 22, in fluid communication with the input water pipe 20, is opened to flow the water to be heated; and the hot water is continuously outputted from the output hot water pipe 18. In this case, opening the valve 22 turns on the pressure switch 23, which is operatively connected to and turns on the sheath heater 17. The water flowing into the tank 16 from the input water pipe 20 is throttled and accelerated by the input water opening 20*a* of the input water pipe 20. The water reaches as far as the upper portion of the tank 16, hits the inner wall of the tank top-face 16*b* under the temperature sensing portion 21*a* of the thermostat 21, and is reversed and diffused to go to the lower portion of the tank 16 while being heated by the sheath heater 17. The water heated by the sheath heater 17 is throttled, accelerated and mixed by the first opening portion 18*a* of the output hot water pipe 18 to flow into the output hot water pipe 18. It passes the heat-sensing portion 19*a* and is outputted through the output hot water pipe 18. The temperature of the hot water outputted through the first opening portion 18*a* is detected by the temperature detector 19, and a corresponding output signal is generated and sent to a semicondutor power control unit or apparatus 24. The semiconductor apparatus 24 to which the detection signal has been inputted compares the detection temperature with the set temperature to control in pulse the switching element 24*a* , such as a triac or the like, in accordance with the preset deviation value to control the power to a sheath heater 17 so that the deviation value may be maintained at zero.

Also, by closing the valve 22, the operatively connected pressure switch 23 is turned off which stops the sheath heater 17.

Figure 6:
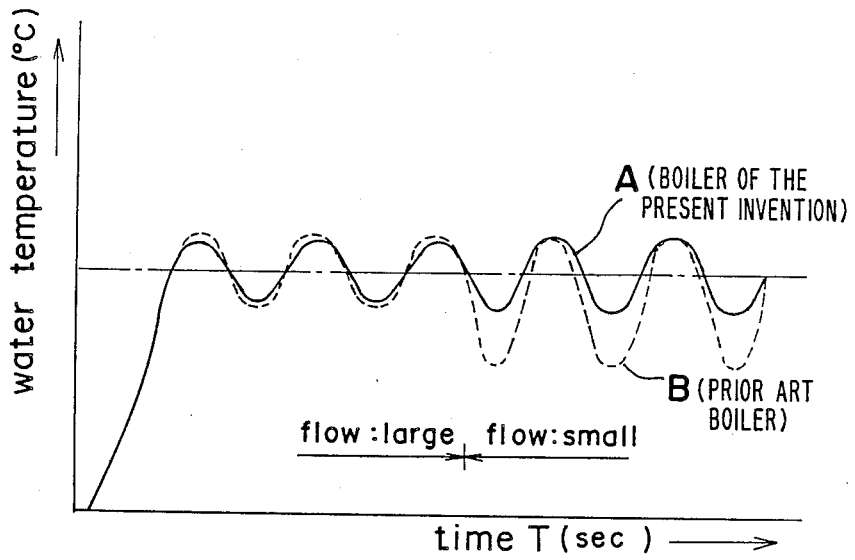
FIG. 6 is an output hot water characteristics comparison chart of the electric instantaneous boiler of the present invention (A) and a conventional electric instantaneous boiler (B)
Figure 7:
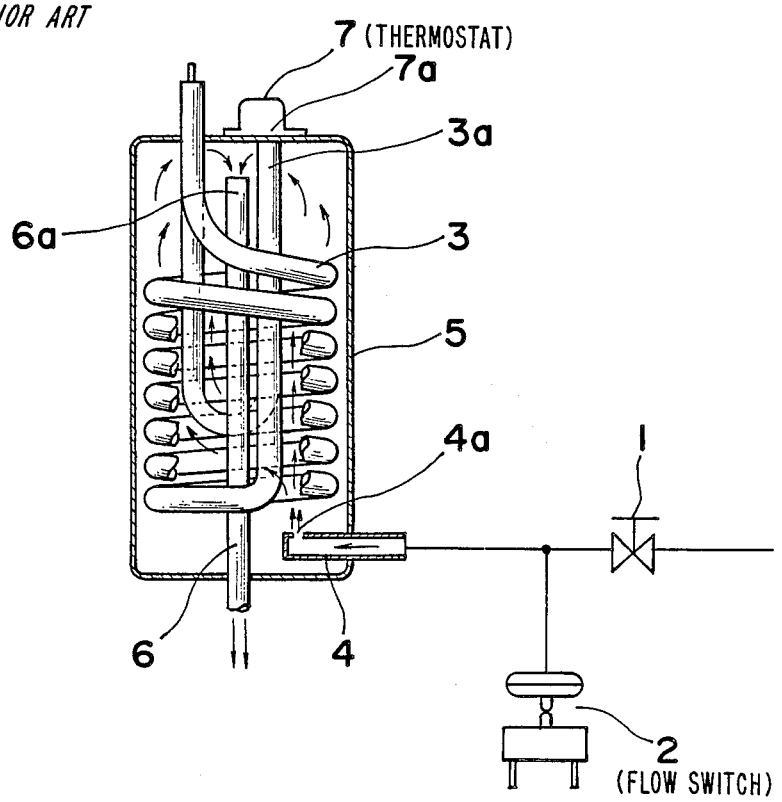
Fig. 7 PRIOR ART
FIG. 7 and FIG. 8 each show a longitudinal sectional view of the thermal exchange unit of a conventional electric instantaneous boiler.
Figure 8:
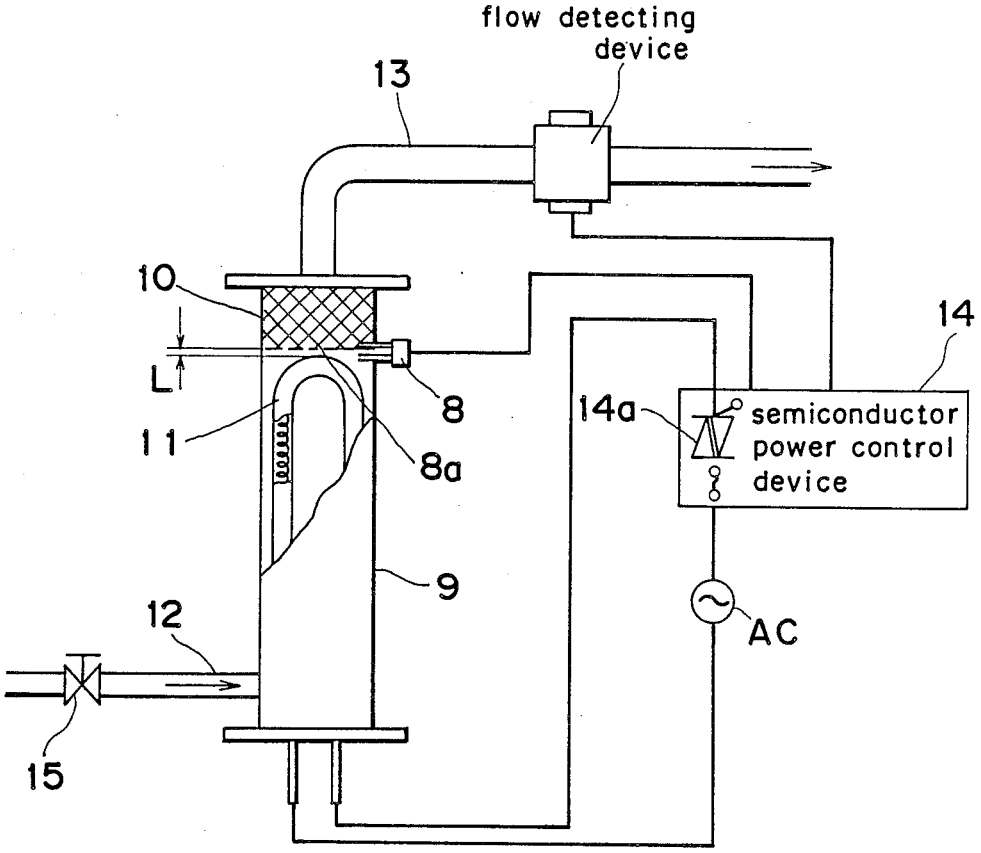
Fig. 8 PRIOR ART
Figure 9:
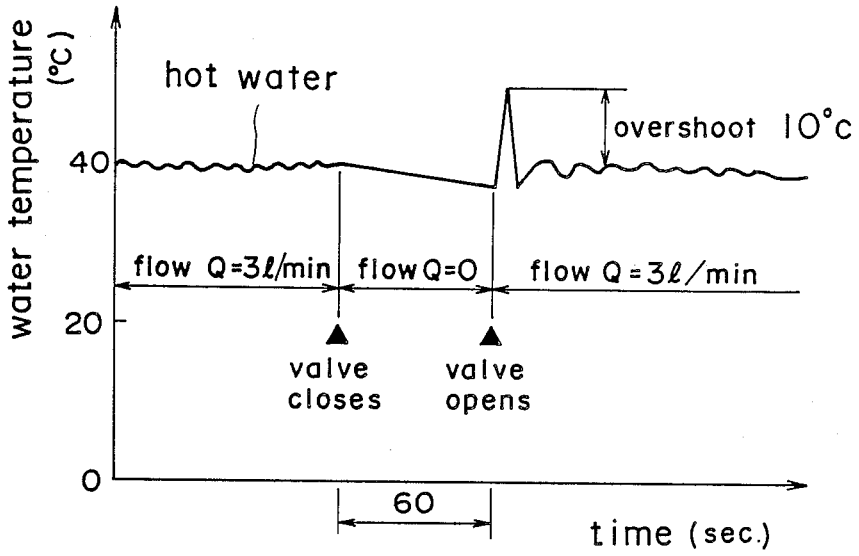
Fig. 9 PRIOR ART
FIG. 9 is a characteristics chart of the output hot water temperature change during the opening and closing operation of a conventional valve.
Figure 10:
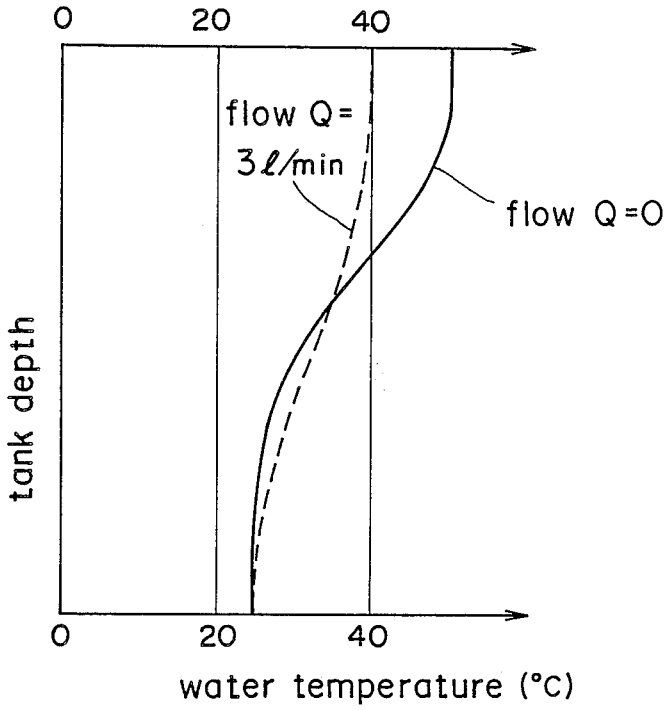
Fig. 10 PRIOR ART
FIG. 10 is a characteristics chart of the hot water temperature distribution with a conventional tank.
Figure 11:
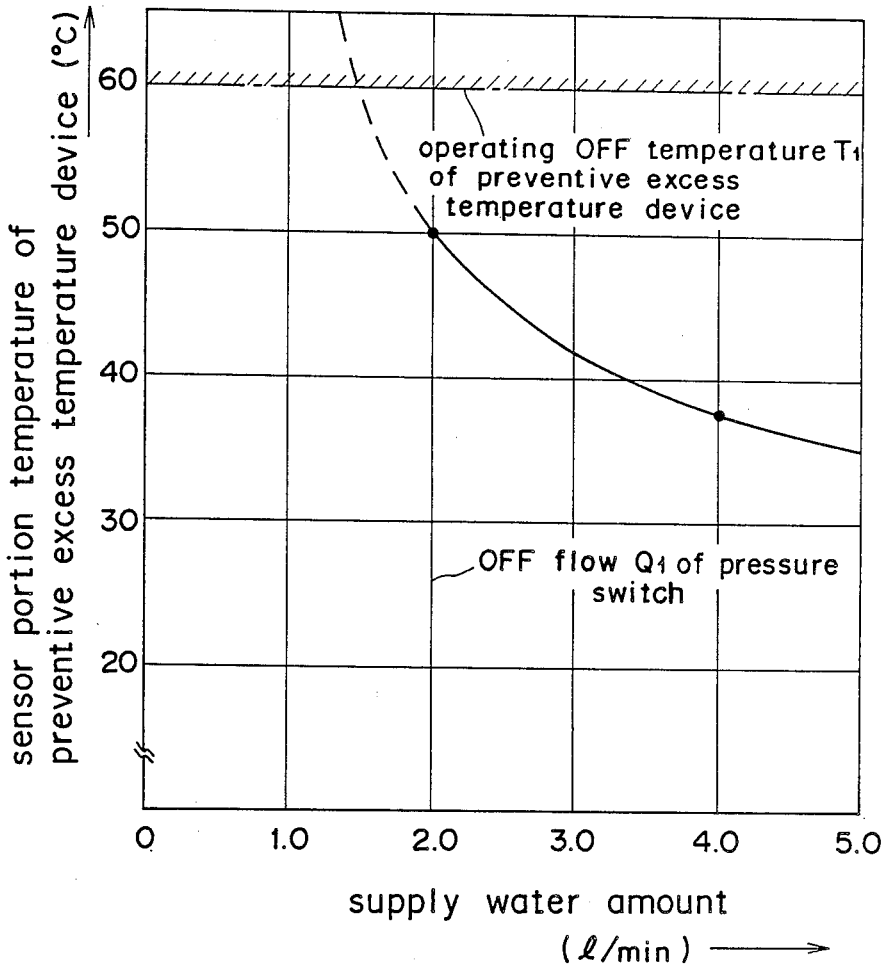
Fig. 11 PRIOR ART
FIG. 11 shows the relationship between the output hot water amount of a conventional electric instantaneous boiler and the temperature sensing portion temperature of the excessive temperature rise preventing apparatus.

Namely, although there is the space between the sensing portion 19*a* and the lower portion of the sheath heater 17, the heated water is throttled by the first opening portion 18*a* and is accelerated, mixed so that the lag time becomes small and superior thermal response is provided. Also, as the heat sensing portion 19*a* is not directly adjacent the sheath heater 17, direct thermal influences are not applied thereto from the sheath heater 17. If the flow volume is small, the hot-water temperature is still positively detected without any detection of the temperature of the sheath heater 17, so that a stable output hot water temperature where the deviations are small may be provided as in A or FIG. 6.

Also, as the flow speed near the heat-sensing portion 19*a* is fast, the buildup of scale is low and the initial control characteristics may be maintained even after a long period of service.

Also, as the output hot water pipe 18 is enlarged so that the outer diameter approaches the inner diameter of the sheath heater 17, the volume of the heating chamber 25 becomes small, the flow small, the flow speed near the sheath heater 17 increases to improve the thermal efficiency, and the responsiveness of the automatic control system of the automatic hot-water temperature control by the temperature detector or sensor 19 is improved. On the other hand, the air contained in the input water, within the tank 16 at the early stage of heating, is removed by the air pressure within the tank 16 through the output hot water pipe 18 by the second opening portion 18*b* serving as the air vent hole, so that the sheath heater 17 is not abnormally overheated through exposure to air, which is a poor conductor of heat as compared with water.

Figure 3:
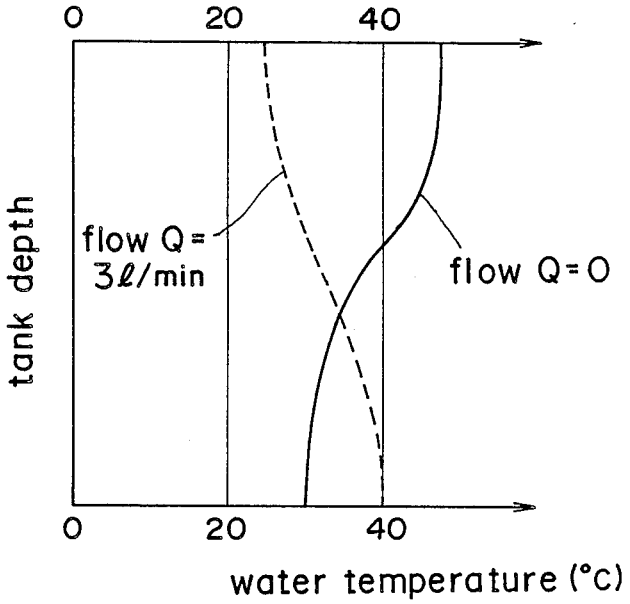
FIG. 3 is a hot water temperature distribution characteristics chart within the tank.

A case where the valve 22 is fully closed, and is opened again a few minutes later will be described hereinafter. The hot water temperature distribution within the tank 16 in the water-flowing condition before the valve 22 is closed shows such temperature distribution as shown in the dotted lines of FIG. 3, wherein the upper portion of the tank 16 is low in temperature and the lower portion of the tank is high in temperature. But, when the valve 22 is fully closed, the flow within the tank 16 stops, and the sheath heater 17 stops heating through its being operatively connected thereto. The water within the tank 16 is heated by the residual heat of heater 17 and the distribution of the hot water temperature within the tank 16 becomes as shown in the solid line of FIG. 3, wherein the upper portion of the tank 16 is high in temperature and the lower portion thereof is low in temperature and the lower portion thereof is low in temperature because of convection. When the valve 22 opens again, the hot water is outputted from the output hot water pipe through the first opening portion 18*a* from the low-temperature water of the lower portion of the tank 16, so that the high-temperature water of the upper portion of the tank 16 is mixed with the input water from the input water pipe 20. Although the sheath heater 17 is on the water within the tank 16 is not sufficiently heated at the early stage owing to the delayed temperature rise.

Figure 2:
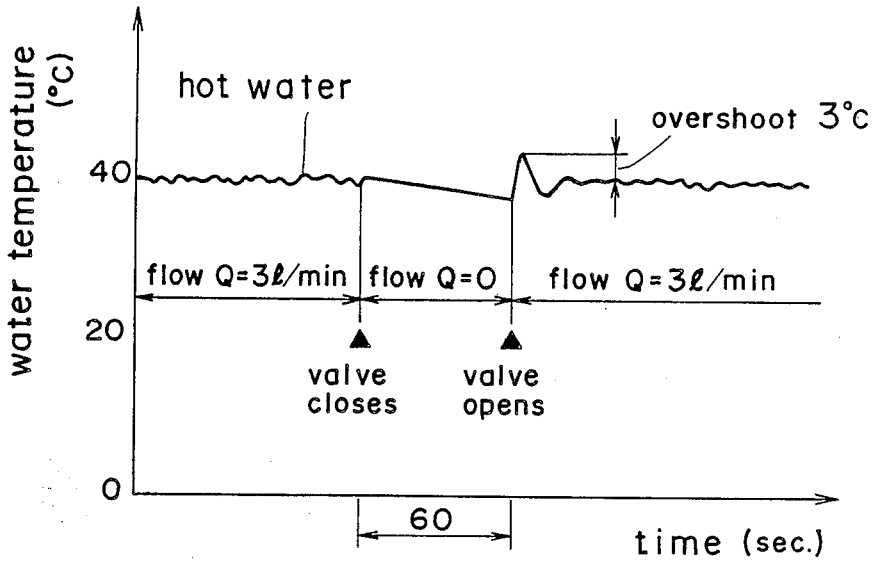
FIG. 2 is a characteristic chart of the output hot water temperature change during the opening and closing operation of the valve.

As a result, the changes in the output hot water temperature occur as shown in FIG. 2. The overshoot owning to the residual heating is about 3° C., which hardly matters.

Figure 5:
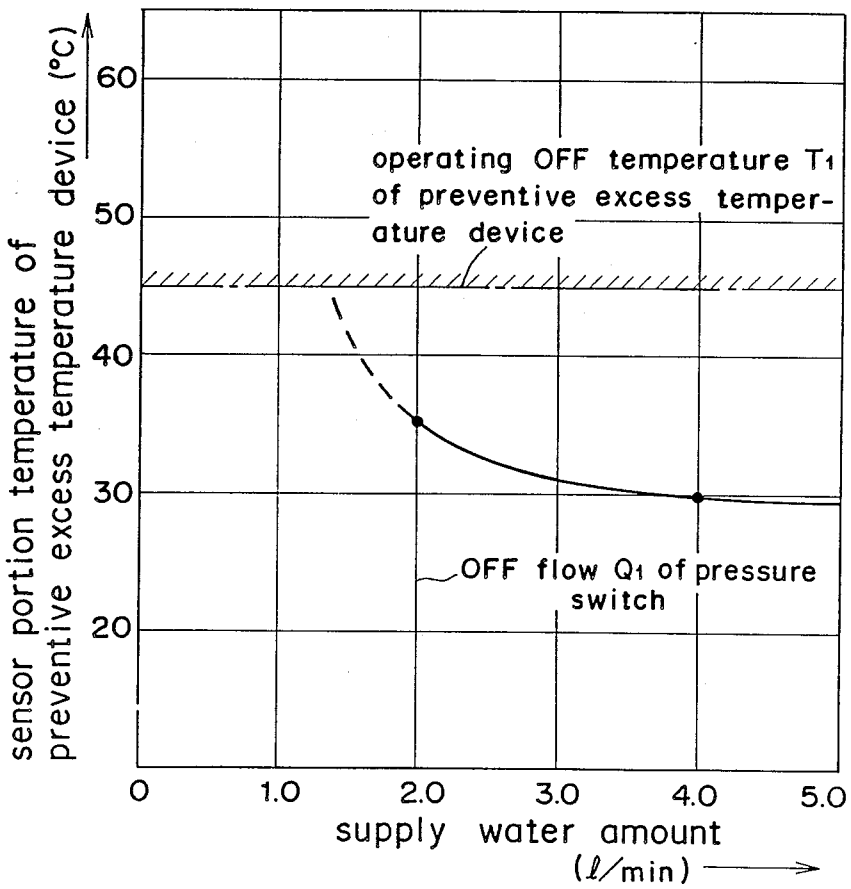
FIG. 5 is a characteristic chart showing the relationship between the output hot water amount and the temperature sensing portion temperature of the excessive temperature rise preventing apparatus.
Figure 4:
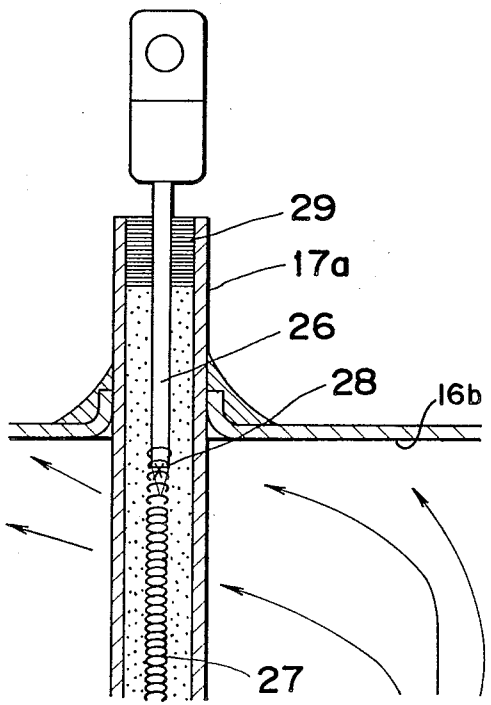
FIG. 4 is an enlarged longitudinal sectional view near the heater-soldered portion.

The "abnormal condition" (in which the heater is on although the water flow is off, as described above) will be described hereinafter by the use of FIG. 5. In this case, when the valve 22 is closed, the inflow amount W of the water into the tank 16 is removed, but the sheath heater 17 remains on. The water within the tank 16 is quickly heated and the water temperature of the upper portion of the tank 16 rises, especially because of convection. Furthermore, the temperature of the heat sensing portion 21*a* of the thermostat 21 quickly rises because of the thermal transmission from the lead portion 17*a* so that the thermostat 21 turns off at the operation-off temperature T1 of the excessive-temperature rise-preventing apparatus; this turns the sheath heater 17 off. Namely, the temperature of the heat sensing portion 21*a* of the thermostat 21 is lowered by the input water during normal operation and is kept at the low temperature as shown in the solid line in FIG. 5 so that the operation-off temperature T1 of the excessive-temperature-rise-preventing apparatus of the thermostat 21 may be set low. Also, during the "abnormal condition," the cooling effect of the input water flow is not available and the temperature quickly rises and, hence, the sheath heater 17 is quickly turned off, whereby a dangerous condition such as the jetting of boiling water from the output hot water pipe 18, the deformation of the tank owing to pressure buildup, of the like is prevented from occurring.

Also, in the present embodiment, as the input water opening 20*a* at the tip end of the input water pipe 20 is throttled, the input water pipe 20 is easy to be inserted into the tank 16 during the assembling operation.

As is clear from the foregoing description, according to the arrangement of the present invention, the electric instantaneous boiler of the present invention has the inlet opening portion of the output hot water pipe provided in the lower portion of the tank, so that the overshoot of the output hot water temperature owing to the residual heating of the sheath heater after being turned off may be reduced. Furthermore, as the air vent opening is provided in the output hot water pipe at the upper portion of the tank, no air pocket forms in the upper portion and abnormal excessive heating of the sheath heater may be prevented. Also, as the heat sensing portion of the hot water temperature detector is at the inlet output hot water opening and is located at a position where the thermal influences of the heater are not applied, the thermal response property thereof is superior and a stable output hot water temperature is provided. Furthermore, as the temperature sensing portion of the excessive-temperature-rise-preventing apparatus is provided on the tank upper surface on the centerline of the input water pipe, the heater is quickly shut off during the "abnormal operation" to prevent accidents from being caused.

Although the present invention has been fully described by way of example with reference to the accompanying drawings, it is to be noted here that various changes and modifications will be apparent to those skilled in the art. Therefore, unless such changes and modifications depart from the scope of the present invention, they should be construed as being included therein.

What is claimed is:

1. An instantaneous boiler comprising:

a tank for holding water;

an immersion heater disposed within said tank;

a control unit for controlling energization of said immersion heater and operatively connected to said immersion heater;

an input water pipe attached to said tank for flowing water to be heated into said tank;

an output hot water pipe, disposed within said tank, for flowing heated water from said tank;

a thermostat attached to said tank for measuring substantially the temperature of the water which is within said tank yet outside said output hot water pipe, said thermostat being operatively connected to said immersion heater for controlling said heater responsive to the measured temperature of the water;

an output hot water temperature sensor for measuring the temperature of the heated water within said output hot water pipe, said output hot water temperature sensor producing output signals responsive to the temperature of the heated water, and said output hot water temperature sensor being operatively connected to said control unit for supplying the output signals to said control unit, said control unit including a means responsible to the output signals for controlling the operation of said heater;

said output hot water pipe extending between the upper and lower portions of said tank, and said output hot water pipe having a discharge end extending through the top portion of said tank;

a first opening portion provided in the lower portion of said output water pipe, opening into the lower portion of the interior of said tank, said first opening portion serving as an inlet for heated water flowing into said output hot water pipe; and said output hot water temperature sensor having a heat-sensing portion located within said output hot water pipe at the lower portion thereof and substantially directly adjacent said first opening portion.

2. The boiler of claim 1, wherein;

said first opening portion in the lower portion of said output hot water pipe is smaller than the cross-sectional area of said output hot water pipe for accelerating and mixing the water as it flows into said output hot water pipe, whereby said output hot water temperature, heat-sensing portion within said output pipe measures uniform water temperatures, and the accelerated water reduces the buildup of scale from impurities in the water on said temperature sensor, and whereby the life of said sensor is extended.

3. The boiler of claim 1, wherein said thermostat is disposed at an upper portion of said tank.

4. The boiler of claim 3, wherein said input water pipe has means for directing water to be heated toward said thermostat, and away from said heater, whereby said thermostat measures substantially the temperature of the water to be heated.

5. The boiler of claim 3, wherein said input water pipe is attached at the lower portion of said tank and laterally offset from the lower portion of said output hot water pipe.

6. The boiler of claim 1, wherein said input water pipe has means for directing water to be heated toward said thermostat, and away from said heater, whereby said thermostat measures substantially the temperature of the water to be heated.

7. The boiler of claim 6, wherein said input water pipe is attached at the lower portion of said tank and laterally offset from the lower portion of said output hot water pipe.

8. The boiler of claim 1, wherein said input water pipe is attached at the lower portion of said tank and laterally offset from the lower portion of said output hot water pipe.

9. The boiler of claim 1, wherein said heater is sheath type heater, said heater being adjacent to and substantially surrounding said output hot water pipe.

10. The boiler of claim 1, wherein said output hot water pipe has a second opening portion at the upper portion thereof for venting air from the upper portion of said tank to said outlet hot water pipe.

11. An instantaneous boiler comprising:

a tank for holding water;

an immersion heater disposed within said tank;

a control unit for controlling energization of said immersion heater and operatively connected to said immersion heater;

an input water pipe attached to a lower portion of said tank for flowing water to be heated into said tank;

an output hot water pipe disposed within said tank for flowing heated water from said tank;

said immersion heater being adjacent to and substantially surrounding said output hot water pipe;

an excessive-temperature-sensing thermostat attached at an upper portion of said tank for measuring substantially the temperature of the water which is within said tank yet outside of said output hot water pipe, said thermostat being operatively connected with said immersion heater for controlling said heater responsive to the temperature of the water measured by said excessive-temperature-sensing thermostat, said thermostat being offset from a volume defined by outermost portions of said output hot water pipe and said immersion heater;

an output hot water temperature sensor for measuring the heated water within said output hot water pipe, said output hot water temperature sensor being attached to said tank, said sensor producing output signals responsive to the temperature of the heated water, said temperature sensor being operatively connected to said control unit for supplying signals to said control unit;

said control unit having means for comparing a preset temperature and the measured output hot water temperature and for shutting off said heater when the measured output water temperature exceeds the preset temperature; and said input water pipe having means for directing the water to be heated away from said output hot water pipe and said heater, said means directing the water to be heated toward said thermostat, said thermostat measuring substantially the temperature of the water to be heated, and said output hot water pipe and said heater being located laterally of the path of the water direction by said input water pipe toward said thermostat, and providing substantially no interference with the flow of water from said input pipe to said thermostat.

12. The boiler of claim 11, wherein said output hot water pipe extends between the upper portion to the lower portion of said tank and has an opening into the lower portion of the interior of said tank, said opening receiving heated water at the lower portion thereof.

13. The boiler of claim 11, wherein said means for directing the water to be heated is an opening in said input water pipe which opens into the interior of said tank, said opening having an area smaller than the cross-sectional area of said input water pipe for accelerating and directing the input water toward said thermostat.

14. The boiler of claim 13, wherein said opening in said input water pipe has a center line, and said thermostat is aligned substantially with the centerline.

15. The boiler of claim 11, wherein the heater is a coil-shaped heater.

* * * * *